US010306345B2

(12) United States Patent
Imamura

(10) Patent No.: US 10,306,345 B2
(45) Date of Patent: May 28, 2019

(54) HEADPHONE

(71) Applicant: Vie Style, Inc., Kanagawa (JP)

(72) Inventor: Yasuhiko Imamura, Kanagawa (JP)

(73) Assignee: Vie Style, Inc., Kanagawa (JP)

( * ) Notice: Subject to any disclaimer, the term of this patent is extended or adjusted under 35 U.S.C. 154(b) by 0 days.

(21) Appl. No.: 15/573,147

(22) PCT Filed: Aug. 21, 2015

(86) PCT No.: PCT/JP2015/073559
§ 371 (c)(1),
(2) Date: Nov. 10, 2017

(87) PCT Pub. No.: WO2016/181577
PCT Pub. Date: Nov. 17, 2016

(65) Prior Publication Data

US 2018/0206013 A1 Jul. 19, 2018

Related U.S. Application Data

(63) Continuation-in-part of application No. PCT/JP2015/063805, filed on May 13, 2015.

(51) Int. Cl.
*H04R 1/10* (2006.01)
*H04R 1/02* (2006.01)
(Continued)

(52) U.S. Cl.
CPC ..... *H04R 1/025* (2013.01); *H04R 1/00* (2013.01); *H04R 1/06* (2013.01); *H04R 1/10* (2013.01);
(Continued)

(58) Field of Classification Search
CPC .... H04R 1/10; H04R 2205/022; H04R 1/105; H04R 5/0335; H04R 2201/10; H04R 2460/13; H04R 1/1016
(Continued)

(56) References Cited

U.S. PATENT DOCUMENTS 3,891,810 A * 6/1975 Hayashi ..... H04R 1/1008 381/373
4,005,278 A * 1/1977 Gorike ..... H04R 5/033 381/371
(Continued)

FOREIGN PATENT DOCUMENTS

CN 103179480 A 6/2013
CN 103475969 A 12/2013
(Continued)

OTHER PUBLICATIONS

International Patent Application No. PCT/JP2015/063805; International Search Report and Written Opinion, dated Aug. 18, 2015, 14 pages.

*Primary Examiner* — Suhan Ni
(74) *Attorney, Agent, or Firm* — Morgan, Lewis & Bockius, LLP

(57) ABSTRACT

A headphone having a pair of housings including speaker units, an ear accommodating portion having a frame surrounding an ear and in contact with a head part and a connection portion connecting the frame and the housing, covering the ear, and providing ventilation to the ear, and an arm connecting the pair of housings to each other.

11 Claims, 16 Drawing Sheets

(51) Int. Cl.

| | |
|---|---|
| ***H04R 1/00*** | (2006.01) |
| ***H04R 1/06*** | (2006.01) |
| ***H04R 7/04*** | (2006.01) |
| ***H04R 3/00*** | (2006.01) |
| ***H04R 5/033*** | (2006.01) |

(52) U.S. Cl.
CPC ..... *H04R 1/1008* (2013.01); *H04R 1/1033* (2013.01); *H04R 1/1041* (2013.01); *H04R 3/007* (2013.01); *H04R 5/0335* (2013.01); *H04R 7/04* (2013.01); *H04R 2420/07* (2013.01)

(58) Field of Classification Search
USPC ..... 381/370–374, 376–381, 383
See application file for complete search history.

(56) References Cited

U.S. PATENT DOCUMENTS

| | | | | |
|---|---|---|---|---|
| 4,993,074 | A * | 2/1991 | Carroll | H04R 5/033 381/373 |
| 5,844,998 | A * | 12/1998 | Nageno | H04R 1/2842 381/371 |
| 5,884,998 | A | 12/1998 | Nageno | |
| 7,983,438 | B2 * | 7/2011 | Tsunoda | H04R 1/1016 381/370 |
| 8,582,796 | B2 * | 11/2013 | Kimura | H04R 1/1008 381/371 |
| 2002/0131616 | A1 | 9/2002 | Bronnikov et al. | |
| 2006/0188121 | A1 | 8/2006 | Tsunoda | |
| 2015/0281828 | A1 | 10/2015 | Horikawa | |

FOREIGN PATENT DOCUMENTS

| | | |
|---|---|---|
| DE | 19720396 | 5/1997 |
| JP | S53-041219 | 4/1978 |
| JP | S54-087523 | 7/1979 |
| JP | H05-130696 | 5/1993 |
| JP | H10-032892 | 2/1998 |
| JP | 2002-536899 A | 10/2002 |
| JP | 2005-311448 A | 11/2005 |
| JP | 2011-015338 | 1/2011 |
| JP | 2012249020 | 12/2012 |
| JP | 2013-251750 | 12/2013 |
| JP | 2015056837 | 3/2015 |
| WO | 2013/099516 | 7/2013 |
| WO | 2015/045993 | 4/2015 |

* cited by examiner

HEADPHONE

CROSS-REFERENCE TO RELATED APPLICATIONS

This application is a U.S. National Phase Application under 35 U.S.C. 371 of International Application No. PCT/JP2015/073559 filed Aug. 21, 2015, which claims priority to International Application No. PCT/JP2015/063805 filed May 13, 2015, all of which are incorporated herein by reference in their entireties.

TECHNICAL FIELD

The present invention relates to a headphone.

BACKGROUND ART

Open-air type headphones have been conventionally known. For example, open-air type headphones have a large number of predetermined holes formed on their housings, for example, through which holes a sound output from the headphone is heard by people around it or an external sound is heard by a wearer (see Patent Literatures 1 and 2, for example).

CITATION LIST

Patent Literature

Patent Literature 1: JP H05-130696 A
Patent Literature 2: JP 2002-536899 T

SUMMARY OF INVENTION

Technical Problem

However, in a conventional open-air type headphone, an ear pad, a speaker unit and the like cover the entire ear, and the ear is in a closed space. Thus, when the headphone is worn for a long time, the closed space loses ventilation to the entire ear, becoming stuffy, and it is likely that the ear sweats. Then, the wearer gradually begins to feel discomfort with the ear and cannot wear the headphone for a long time.

Thus, an object of the present invention is to provide a headphone in which ventilation to the ear while worn is improved, whereby long-time wearing is enabled.

Solution to Problem

A headphone in an aspect of the present invention has a pair of housings including speaker units, an arm connected to the pair of housings, an ear accommodating portion including a frame in contact with the head part around the ear and a connection portion for connecting the frame and the housing, the connection portion covering the ear and providing ventilation to the ear.

Advantageous Effects of Invention

According to the present invention, ventilation to the ear while worn is improved, and long-time wearing is made possible.

DESCRIPTION OF EMBODIMENTS

Figure 1:
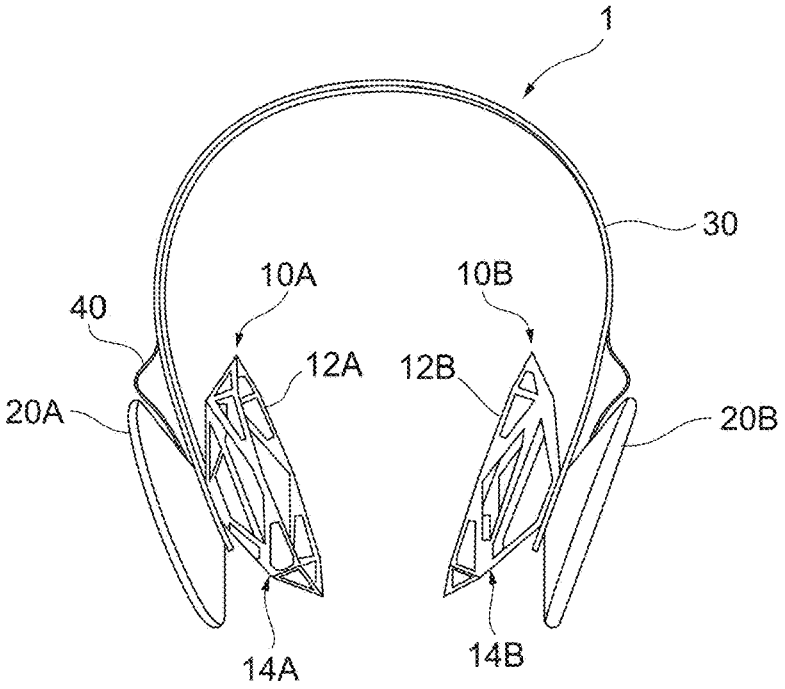
FIG. 1 is a front view of a headphone in a first embodiment.

Embodiments of the present invention will be described below by referring to the attached drawings. However, the embodiments which will be described below are only exemplification and are not intended to exclude application of various variations or arts not explicitly shown below. In other words, the present invention can be put into practice with various variations within a range not departing from its gist. Moreover, in description of the following drawings, the same or similar reference numerals are given to the same or similar portions in expression. The drawings are schematic and do not necessarily match actual dimensions, ratios and the like. The drawings also include portions in which mutual dimensional relationships or ratios are different in some cases.

First Embodiment

An example of a headphone in a first embodiment will be described below by using the drawings.

<Shape of Headphone>

Figure 2:
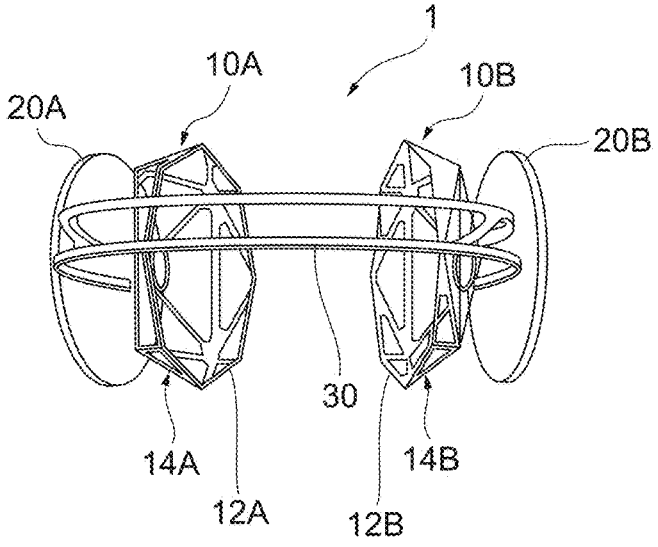
FIG. 2 is a top view of the headphone in the first embodiment.
Figure 3:
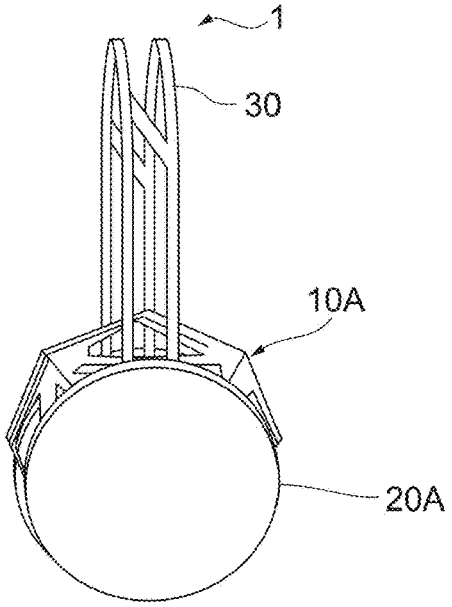
FIG. 3 is a side view of the headphone in the first embodiment.

First, by using FIGS. 1 to 3, an example of a shape of the headphone in the first embodiment will be described. FIG. 1 is a front view of the headphone 1 in the first embodiment. FIG. 2 is a top view of the headphone 1 in the first embodiment. FIG. 3 is a side view of the headphone 1 in the first embodiment.

In FIGS. 1 to 3, the headphone 1 includes a pair of ear accommodating portions 10A and 10B, a pair of housings 20A and 20B, an arm 30, and a cable 40. The ear accommodating portion 10A includes a frame 12A surrounding the ear of a wearer and in contact with the head part and a connection portion 14A connecting the frame 12A and the housing 20A, covering the ear, and providing ventilation to the ear. The ear accommodating portion 10B includes a frame 12B and a connection portion 14B similarly to the ear accommodating portion 10A. When the right and left ear accommodating portions and the right and left housings and the like do not have to be discriminated, they are noted as the ear accommodating portion 10 and the housing 20, and the like. The frame 12 and the connection portion 14 are the same members, for example, but may be different members. The connection portion 14 is connected to the housing 20 at a center part of this housing 20, for example. As a result, the ear accommodating portion 10 can be connected to the center of the housing, whereby a structure can be made stable.

The connection portion 14 of the ear accommodating portion 10 includes a structure covering the ear and providing ventilation to the ear. Moreover, as a shape of the structure of the ear accommodating portion 10, a surface faced with the housing 20, for example, has a projecting shape. In the example illustrated in FIGS. 1 to 3, the shape of the ear accommodating portion 10 is a bowl shape or a polygonal pyramid shape as an example of the projecting shape. The shape of the ear accommodating portion 10 or the connection portion 14 only needs to be capable of covering the ear and having ventilation and may be a dome shape, a conical shape, a truncated cone shape, a polygonal pyramid truncated shape, a columnar shape (cylindrical shape), a polygonal columnar shape or the like.

Moreover, in the example illustrated in FIGS. 1 to 3, the connection portion 14 of the ear accommodating portion 10 includes a mesh structure having a plurality of holes or openings substantially uniformly. In other words, the ear accommodating portion 10 includes a frame structure having a plurality of gaps. Moreover, a size of the hole or the opening may be any size as long as the ventilation to the ear can be ensured.

Moreover, by devising a shape, a size or a position of a hole or an opening largely influencing a visual appearance of the entire headphone 1, designability of the entire headphone 1 can be made excellent. The structures and the shapes of the ear accommodating portions 10A and 10B may be the same or may be different.

The shape of the entire conventional headphone is determined to some degree, and particularly in a conventional ear pad corresponding to the ear accommodating portion 10 of the first embodiment, a novel design has been rarely present. However, in the example illustrated in FIGS. 1 to 3, in the structure of the ear accommodating portion 10, the designability in the shape can be improved while the ear is accommodated and moreover, ventilation is provided. Moreover, the hole or the opening of the ear accommodating portion 10 has a triangular shape, for example, though there are differences in a size, whereby a sense of unity can be given to the design. Moreover, the holes or the openings are preferably provided substantially uniformly across the entire circumference of the ear accommodating portion 10. As a result, the wearer can naturally listen to the external sound.

Moreover, in the first embodiment, the ear accommodating portion 10 is designed so that the entire ear is accommodated in an accommodating space in the ear accommodating portion 10, when it is worn on the head part by surrounding the ear. Thus, the ear accommodating portion 10 is designed so as not to be in contact with the ear basically. However, it is not necessary that the ear accommodating portion 10 is not in contact with the ears of all the people but when a person with a big ear wears it, for example, the ear accommodating portion 10 can be in some contact with the ear or the ear can protrude from the hole or the opening.

The housing 20 includes a speaker unit therein and is a case protecting this speaker unit and is connected to the ear accommodating portion 10. The speaker unit has a flat-surface speaker unit, for example, and moreover, a speaker unit with improved directivity is preferably applied. For example, it is only necessary that the speaker unit is disposed in the housing 20 by considering the position of the speaker unit so that the directivity of an output sound by the speaker unit directly goes toward the external auditory canal of the ear. For example, the speaker unit is disposed so that the sound is output from a center part of the housing 20.

By using the speaker unit having directivity, the output sound directly goes toward the external auditory canal of the ear and thus, a sound leaking from the hole or the opening of the ear accommodating portion 10 can be made as small as possible. For the speaker unit, a well-known art may be used or a commercial one can be employed.

Moreover, the housing 20 includes various components such as a power supply, for example. Details of an inside of the housing 20 will be described by using FIG. 5.

In the shape of the housing 20, a surface faced with the ear accommodating portion 10 has a projecting shape, for example. In the example illustrated in FIGS. 1 to 3, the housing 20 has a bowl shape or a truncated cone shape as an example of the projecting shape. Moreover, the housing 20 may be a dome shape, a conical shape, a polygonal pyramid shape, a polygonal pyramid truncated shape, a columnar shape (cylindrical shape), a polygonal columnar shape or the like.

Moreover, the housing 20 is an open type or a closed type, for example, and may have a structure with less sound leakage to an outside from the housing 20. Moreover, the housing 20 has a projecting shape similarly to the ear accommodating portion 10, and by connecting the housing 20 and the ear accommodating portion 10 substantially in plane symmetry, a beautiful impression in terms of design can be given.

The arm 30 is a portion supporting the housing 20 and the like and is also a portion for generating a side pressure of the headphone 1. Moreover, the arm 30 has flexibility so as to follow the shape of the head part of the wearer and has a slide mechanism for adjusting a length of the arm 30. Moreover, in the example illustrated in FIGS. 1 to 3, the arm 30 has a shape with a gap provided at a center part and may be formed of two parallel rod-shaped frames, for example. It is preferable that the ear accommodating portion 10 is not largely deformed by receiving a side pressure by the arm 30 while worn.

The arm 30 connects the pair of housings 20 to each other. The arm 30 is connected to the ear accommodating portion 10 or the housing 20, and as illustrated in FIG. 1, for example, a portion in a periphery of an end portion of the arm 30 is connected to a projecting portion (apex portion) of each of the ear accommodating portion 10 and the housing 20. On this portion, the slide mechanism for adjusting the length is provided. This slide mechanism will be described later.

The cable 40 is a flexible cable, for example, and its length is 300 mm as an example and its width is 15 to 20 mm as an example. The cable is connected by a connector in each of the housings. The cable 40 transmits various signals (a sound signal, for example) to right and left speaker units and the like. The cable 40 is not illustrated in FIGS. 2 to 3.

Figure 4:
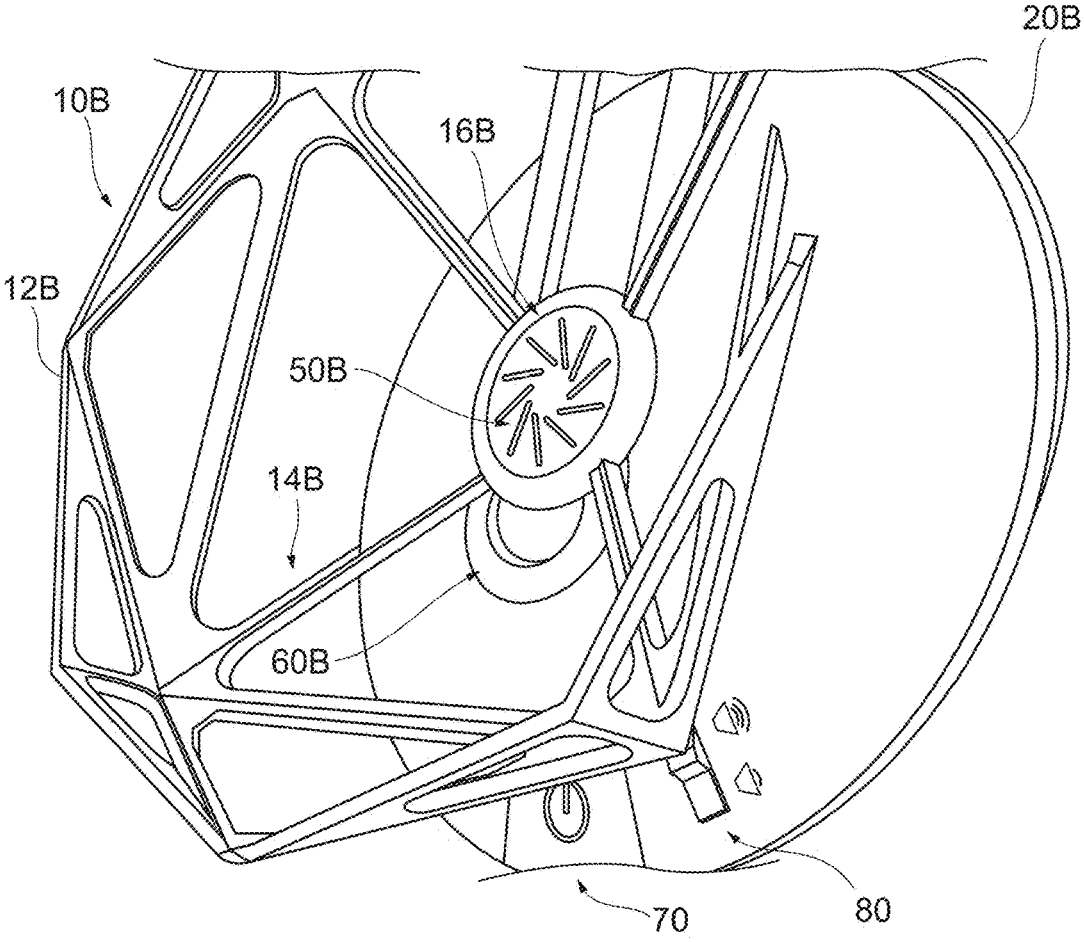
FIG. 4 is an enlarged view of an ear accommodating portion when seen from an inner side of a housing.

FIG. 4 is an enlarged view of the ear accommodating portion 10B and the housing 20B when seen from an inside (ear side). In the example illustrated in FIG. 4, in the ear accommodating portion 10B, a total area of the plurality of hole portions or opening portions is sufficiently larger than a total area of a material of the ear accommodating portion. As a result, ventilation around the ear is improved, and when the ear accommodating portion 10 is worn, steaming of the ear or sweating can be prevented. In the example illustrated in FIG. 4, for example, the total area of the hole portions or the opening portions is approximately 70%, and the total area of the material is approximately 30%. However, it is needless to say that the example illustrated in FIG. 4 is not limiting.

Moreover, in the example illustrated in FIG. 4, in an apex portion 16B (a projecting tapered portion) having a projecting shape of the ear accommodating portion 10B, the ear accommodating portion 10B and the housing 20B are connected, and in this apex portion 16B, the speaker unit 50B is connected so that a direction of the sound output from the speaker unit 50B is directed toward the external auditory canal direction of the ear.

Moreover, the frame 12B (a portion in contact with the ear in a direction opposite to the apex portion) of the ear accommodating portion 10B is in contact with the head part around the ear. At this time, the ear can be accommodated in the accommodating space in the ear accommodating portion 10B. Moreover, the connection portion 14B is a portion connecting the frame 12B and the housing 20B. In the example illustrated in FIG. 4, the apex portion 16B of the connection portion 14B is connected to the housing 20B.

By using the example illustrated in FIG. 4, in the structure of the ear accommodating portion 10B, a substantially perpendicular section in the housing 20B direction from a head part direction will be described. The frame 12B in contact with the head part has an octagonal shape, for example, and the apex portion 16B connected to the housing 20B has a circular shape, for example, and the shape of the connection portion 14B between this octagonal shape and the circular shape has a square shape, for example.

Moreover, there is a predetermined width among the octagonal shape, the square shape, and the circular shape, respectively, and this width only needs to have a width capable of accommodating the ear. The ear accommodating portion 10B has a frame structure connected from a corner of the octagonal shape to a corner of the square shape by a rod-shaped member, respectively, and connected from the corner of the square to a portion obtained by dividing the circle into 4 parts by the rod-shaped member, respectively. In other words, the ear accommodating portion 10B has, as illustrated in FIG. 4, a multi-layered structure and includes the rod-shaped member connecting from a predetermined position of a predetermined layer to a predetermined position of another layer in an outer frame of each layer. As a result, in the ear accommodating portion 10B, the accommodating space can be formed easily and strength of the ear accommodating portion 10B can be kept efficiently.

This frame structure may be molded integrally by a resin or the like with a gap present or may be molded by partial assembling. Moreover, the ear accommodating portion 10B has a relationship of an area of the octagonal shape>an area of the square shape>an area of the circle. Moreover, the outer frame from the octagonal shape to the circular shape has a dome shape so as to be capable of covering the ear. The structure of the ear accommodating portion 10 illustrated in FIGS. 1 to 4 is only an example, and it may be another frame structure having a gap so that air flows between an outer side and an inner side of the ear accommodating portion 10.

Moreover, in the example illustrated in FIG. 4, a slide mechanism 60B of the arm 30 has a mechanism of sliding on this apex portion (projecting portion). For example, the slide mechanism 60B sandwiches the gap in the center part of the arm 30 in a connection portion (projecting portion) between the housing 20B and the ear accommodating portion 10B so that the connection portion can slide in the gap easily. Moreover, the slide mechanism 60B also includes a locking mechanism for being locked at a predetermined position after sliding. Thus, the gap across the center of the arm 30 improves designability and makes it easy to have flexibility and moreover, can serve as a part of the slide mechanism.

On the inner side (ear side) of the housing 20B, a first switch 70 and a second switch 80 are provided. The first switch 70 is a power switch, for example, and switches ON and OFF of a power supply of the headphone 1. Moreover, the second switch 80 is a switch for adjusting a volume of the speaker unit 50B and only needs to be configured such that a plurality of output levels can be selected as appropriate by a user. A button example illustrated in FIG. 4 is only an example, and this example is not limiting.

Figure 5:
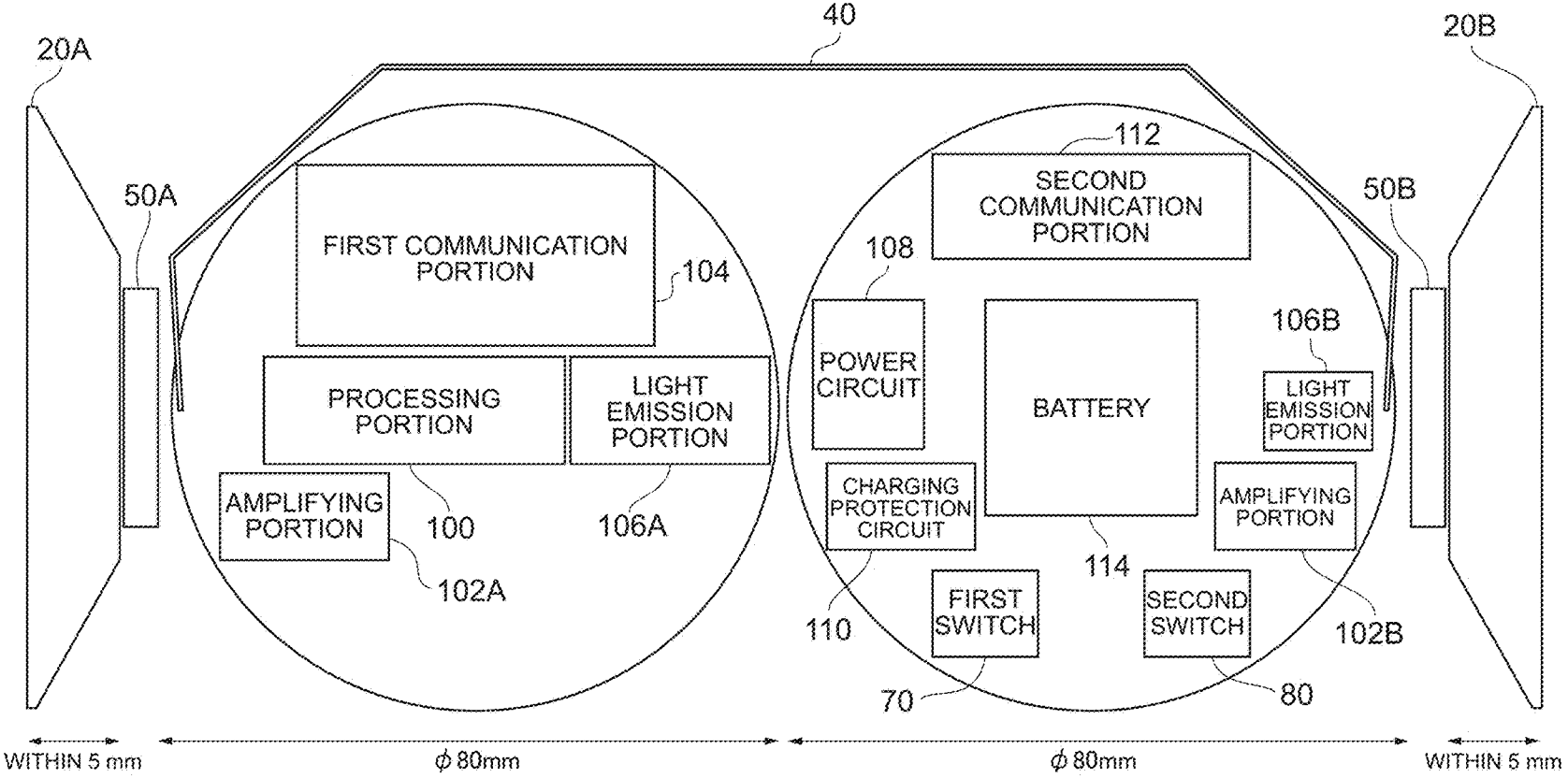
FIG. 5 is a view illustrating an example of a constitution in the housing.

FIG. 5 is a view illustrating an example of configuration in the housing 20. In the example illustrated in FIG. 5, a thickness of a substrate in the housing 20 is within 5 mm, for example. As a result, a thickness of the housing 20 can be thinned, and a stylish impression can be given in terms of design. Moreover, a diameter of the housing 20 is assumed to be 80 mm, for example.

In the example illustrated in FIG. 5, the housing 20A includes a processing portion 100, an amplifying portion 102A, a first communication portion 104, a light emission portion 106A, and a speaker unit 50A.

The processing portion 100 is a Central Processing Unit (CPU), for example, and converts a sound signal from a digital signal to an analog signal, executes collation processing of information extracted from the obtained sound signal, controls light emission of the light emission portion 106A and the like.

The amplifying portion 102A amplifies the sound signal processed in the processing portion 100 and outputs the amplified signal to the speaker unit 50A. As a result, a sound is output from the speaker unit 50A.

The first communication portion 104 is a module having a wired or wireless communication function, for example, and communicates various signals. For example, the first communication portion 104 preferably conducts communication by using the wireless communication function. Moreover, the first communication portion 104 conducts communication with a Personal Computer (PC), an information processing device including a mobile terminal such as a smartphone, another headphone 1 and the like. By means of this first communication portion 104, a plurality of headphones 1 become capable of outputting communicated sounds in synchronization. The first communication portion 104 conducts short-range wireless communication using 2.4 GHz, for example, and is capable of switching between a transmission mode and a reception mode as appropriate. In the following, the first communication portion 104 will be described by using the case conducting this short-range wireless communication as an example.

The light emission portion 106A is what emits light such as an LED, for example, and is preferably provided in a peripheral edge portion in the housing 20A. In the peripheral edge portion, for example, four LEDs are disposed so that the respective intervals become equal. By means of this light emission portion 106A, light control can be executed in accordance with the sound and light performance can be arranged in accordance with the plurality of headphones 1 on the basis of a light emission control signal.

The housing 20A may have a headphone jack having a diameter of 3.5 mm, for example, though not shown.

In the example illustrated in FIG. 5, a housing 20B includes a first switch 70, the second switch 80, an amplifying portion 102B, a light emission portion 106B, a power circuit 108, a charging protection circuit 110, a second communication portion 112, a battery 114, and a speaker unit 50B.

The first switch 70 is a switch for turning ON or OFF the power supply, for example, as described above. The second switch 80 is a switch for adjusting a volume output from the speaker unit, for example, as described above.

The amplifying portion 102B amplifies a sound signal obtained from the cable 40 and outputs the amplified sound signal to the speaker unit 50B. As a result, sound is output from the speaker unit 50B.

The light emission portion 106B is basically similar to the light emission portion 106A. The light emission portion 106B may have light emission controlled in synchronization with the light emission portion 106A.

The power circuit 108 is a power circuit for generating required output power from input power. The charging protection circuit 110 protects overcharge/overdischarge/overcurrent of the battery 114. The battery 114 is a lithium ion polymer secondary battery, for example.

The second communication portion 112 is a module having a function of conducting wireless communication. The second communication portion 112 is a module having a wireless communication function by Bluetooth (registered trademark), for example. The second communication portion 112 can conduct communication with a device having a wireless communication function of a similar standard by this. For example, the second communication portion 112 can conduct communication with a mobile terminal, a PC and the like.

Moreover, the housing 20B may have a connector of a micro USB. Moreover, the configuration of the housing 20A and the housing 20B illustrated in FIG. 5 is not limited to the aforementioned example but the design may be changed as appropriate in accordance with the size and the function in the housing. Moreover, the housing 20 illustrated in FIGS. 1 to 4 has a largest thickness on the center part and thus, a component with a height may be disposed on the center part of the housing 20.

Moreover, the material of the ear accommodating portion 10 is a material using a resin such as silicon, Ultem, TR 90 and the like. Other than them, a material obtained by wrapping a material using a shape memory alloy (NT alloy) or the like with silicon may be used as the material of the ear accommodating portion 10. Moreover, for the ear accommodating portion 10, a characteristic honeycomb structure or a hold technology may be also used.

As described above, in the first embodiment, ventilation to the entire ear part while worn can be ensured by providing the aforementioned constitution of the ear accommodating portion 10, and even if the headphone 1 is worn, steaming of the ear or sweating can be suppressed. Moreover, in the first embodiment, since the wearer does not sweat easily in the ears while worn, the wearer can listen to music or the like for a long time. Moreover, in the first embodiment, the ear accommodating portion 10 is in contact with the head part around the ear while worn, and the structure applies less pressure to the ear and thus, the ear is not easily hurt even if it is worn for a long time. Moreover, in the first embodiment, by providing the constitution of the ear accommodating portion 10 which has not been present conventionally, the headphone 1 with excellent design can be provided. Moreover, with the headphone 1, the wearer can hear an environmental sound of the outside or the like by the structure of the ear accommodating portion 10 having ventilation.

Second Embodiment

Figure 6:
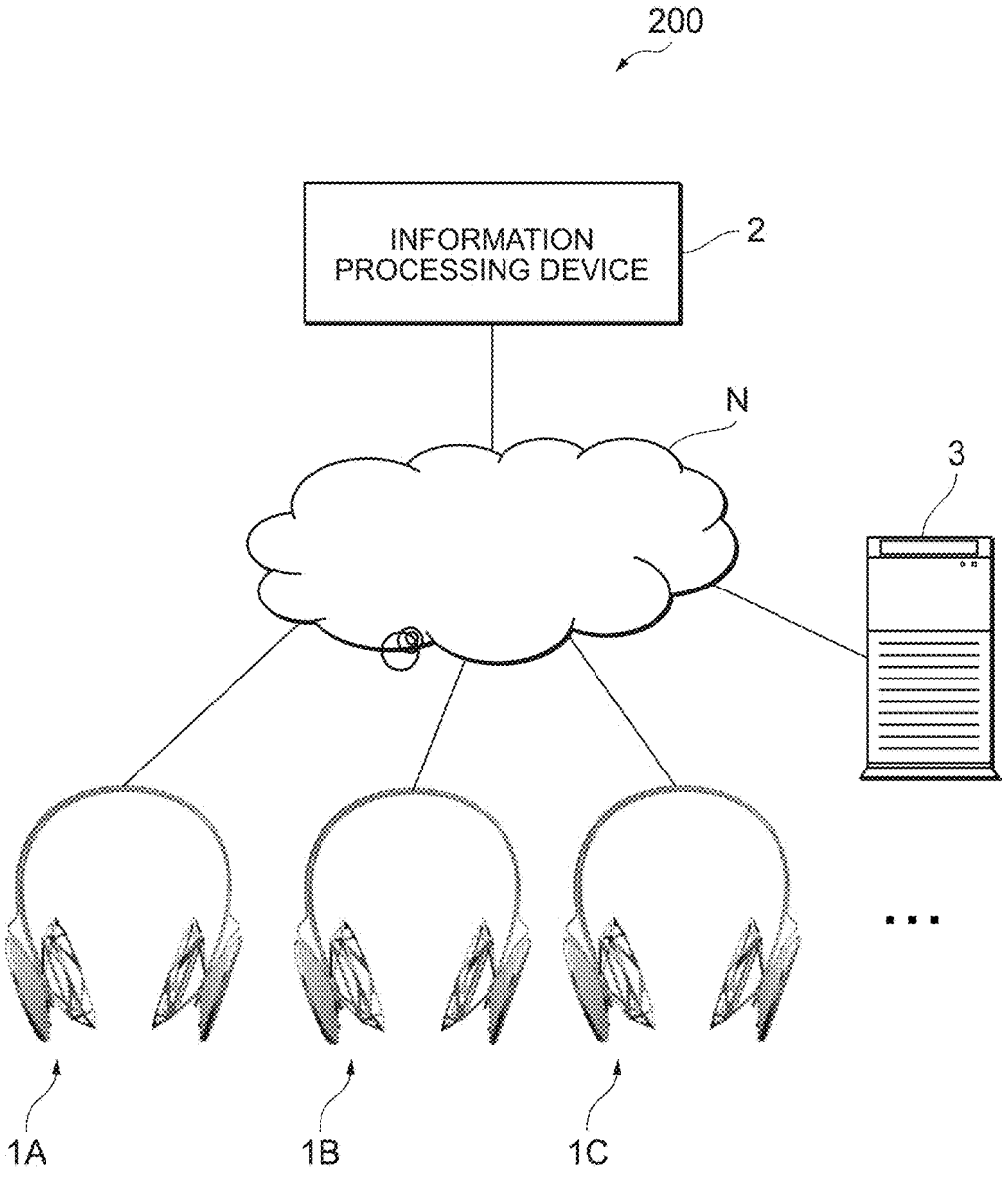
FIG. 6 is a view illustrating an example of a constitution of a delivery system in a second embodiment.

Subsequently, a delivery system 200 in a second embodiment will be described. FIG. 6 is a view illustrating an example of constitution of the delivery system 200 in the second embodiment. In the delivery system 200 illustrated in FIG. 6, headphones 1A, 1B, and 1C, an information processing device 2, and a server 3 are connected via a communication network N. In FIG. 6, one unit of the information processing device 2 is described, but there may be the information processing devices 2 corresponding to the headphones in a one-to-one manner.

The communication network N is constituted by a wireless network or a wired network. As an example of the communication network, a mobile phone network, a PHS (Personal Handy-phone System) network, a wireless LAN (Local Area Network), 3G (3rd Generation), LTE (Long Term Evolution), 4G (4th Generation), WiMax (registered trademark), infrared communication, Bluetooth (registered trademark), a wired LAN, a telephone line, an electric lamp line network, a network conforming to IEEE1394 and the like can be cited.

Moreover, when the headphones 1A, 1B, and 1C do not have to be discriminated from each other, they are noted as a headphone 1. The headphone 1 is similar to the headphone described in the first embodiment.

The information processing device 2 is a PC, a mobile terminal such as a smartphone and an information processing device having a communication network. The information processing device 2 transmits a control signal to each of the headphones 1 or transmits sound data via the communication network N.

The server 3 delivers information of an event using the headphone 1, receives registration of an event from the information processing device 2 or delivers an application for using the headphone 1 to the information processing device 2.

The delivery system 200 in the second embodiment can provide an event such as silent disco in which dancing while listening to the music by a wireless headphone (headphone 1) or the like.

<Constitution of Headphone>

Figure 7:
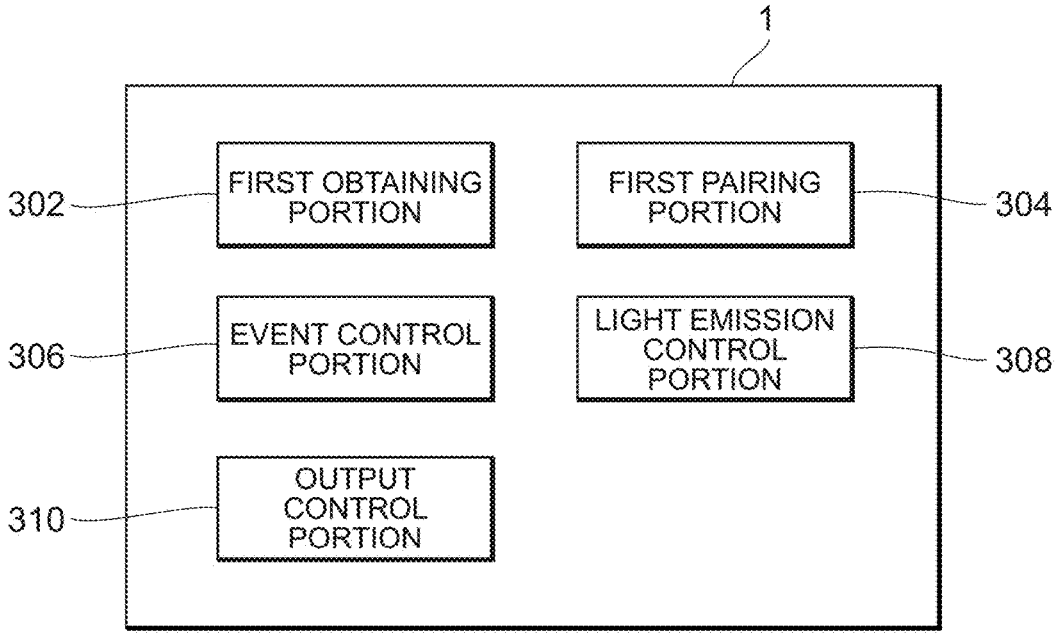
FIG. 7 is a view illustrating an example of a functional constitution of a headphone in the second embodiment.

A hardware constitution of the headphone 1 is as illustrated in FIG. 5 and the explanation will be omitted. FIG. 7 is a view illustrating an example of functional configuration of the headphone 1 in the second embodiment. In the example illustrated in FIG. 7, the headphone 1 has a first obtaining portion 302, a first pairing portion 304, an event control portion 306, a light emission control portion 308, and an output control portion 310.

The first obtaining portion 302, the first pairing portion 304, the event control portion 306, the light emission control portion 308, and the output control portion 310 can be realized by the processing portion 100 illustrated in FIG. 5.

The first obtaining portion 302 obtains various signals received from the other devices. For example, the first obtaining portion 302 obtains a sound signal, a light emission control signal, an event ID, frequency information at which the sound signal is delivered, information relating to pairing and the like from the information processing device 2 or the other headphones 1.

Here, when communication is conducted by using the first communication portion 104 between the headphones 1, it is only necessary that a predetermined headphone is set as a parent, and the other headphones are set as children. At this time, the parent headphone can make simultaneous transmission of music or the like to the child headphones.

The first pairing portion 304 obtains information relating to pairing such as common secret key information (link key) or a session key generated from the link key, for example, from the first obtaining portion 302 and performs pairing by using these pieces of information.

For example, the first pairing portion 304 performs pairing with the information processing device 2 using Bluetooth (registered trademark). As a result, communication in a master-slave relationship is established between the headphone 1 and the information processing device 2. For a method of pairing, a well-known art can be used. By using communication established by this pairing, the first obtaining portion 302 may obtain the event ID or the frequency information used in that event.

The event control portion 306 obtains the event ID, frequency information and the like of the event from the first obtaining portion 302 after the pairing. The event control portion 306 sets the frequency at which the sound signal is delivered in the event on the basis of the frequency information. At this time, the event control portion 306 may output a light emission control signal to the light emission control portion 308 after the frequency is set so that a color indicating a reception enabled state is light-emitted.

The event control portion 306 holds the event ID obtained immediately after the pairing. The event control portion 306 controls an event relating to the headphone 1 by using this event ID or the like. For example, the event control portion 306 controls an event such as silent disco using the headphone 1.

More specifically, first, the event control portion 306 obtains a sound signal transmitted in this event, that is, a sound signal in which an event ID is embedded at every predetermined time in a non-audible region of this sound signal. The predetermined time is 2 minutes, for example. Subsequently, the event control portion 306 collates the event ID extracted from this sound signal with the event ID held therein. The event control portion 306 controls such that reproduction of the sound signal by the output control portion 310 is continued if the event ID is collated. The sound signal includes information or data of music, voices and the like. Moreover, the event control portion 306 executes control such that reproduction of the sound signal by the output control portion 310 is stopped when the event ID is not collated.

As a result, when the paid music is delivered in the event, the music is simultaneously transmitted, and the sound signal can be reproduced only in the specific headphone 1 with which the collation of the event ID was successful.

The light emission control portion 308 obtains a light emission control signal from the first obtaining portion 302 and controls light emission of the light emission portions 106A and 106B on the basis of the light emission control signal. As a result, the headphone 1 can be made to emit light in accordance with the sound, for example. By transmitting one light emission control signal to a plurality of the headphones 1, the plurality of headphones 1 can emit light in synchronization. As a result, light performance can be arranged in a space in which the plurality of headphones 1 are present.

Moreover, the light emission control portion 308 executes control such that the light emission portions 106A and 106B emit a first color when the sound information can be transmitted and executes control such that the light emission portions 106A and 106B emit a second color when the sound signal can be received. The case where the sound signal can be transmitted is that the first communication portion 104 is in a transmission mode, for example, and after the frequency at which the sound signal is delivered is determined, and the case where the sound signal can be received is that the first communication portion 104 is in a reception mode, and after the frequency at which the sound signal is delivered is set, for example.

The output control portion 310 obtains the sound signal from the first obtaining portion 302 and executes control such that the sound is output (reproduced) from the speaker units 50A and 50B. Moreover, the output control portion 310 stops reproduction when stop of the reproduction is instructed by the event control portion 302. The output control portion 310 can control an output of the sound signal other than in the event and controls an output of a sound signal input from the headphone jack or controls an output of the sound signal received from the information processing device 2.

<Configuration of Information Processing Device>

Figure 8:
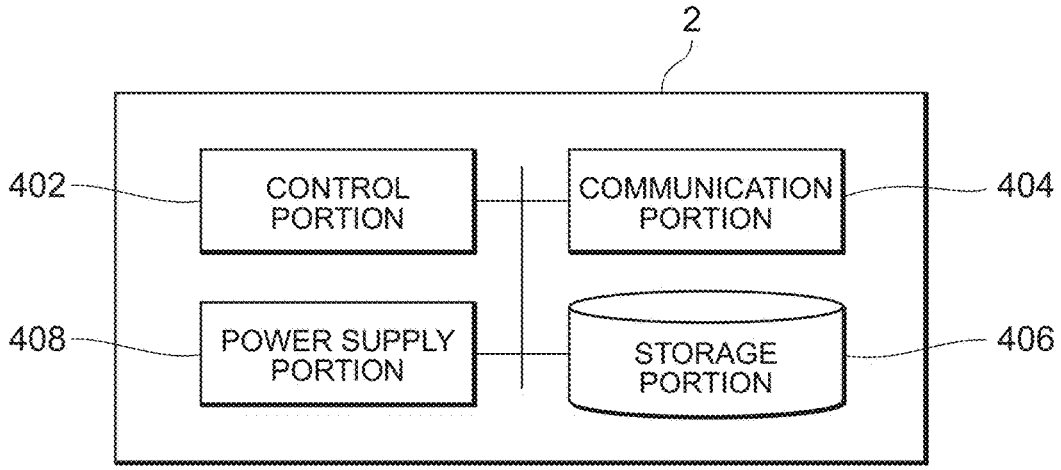
FIG. 8 is a view illustrating an example of a hardware constitution of an information processing device in the second embodiment.

Subsequently, the information processing device 2 in the delivery system 200 will be described. FIG. 8 is a view illustrating an example of hardware configuration of the information processing device 2 in a second embodiment. The information processing device 2 illustrated in FIG. 8 includes at least a control portion 402, a communication portion 404, a storage portion 406, and a power supply portion 408.

The control portion 402 is a CPU, for example, and executes a program extended on a memory and has the information processing device 2 realize various functions. Moreover, the control portion 402 manages sound information to be transmitted to the headphone 1 or manages events. Details of the control portion 402 will be described by using FIG. 9.

The communication portion 404 conducts transmission/reception of data via the communication network N, for example. For example, the communication portion 404 transmits various signals processed by the control portion 402 to the headphone 1 or the like. Moreover, the communication portion 404 receives a signal from the server 3 or the like.

The storage portion 406 stores programs and various data, for example. As the various data, the event information including the event ID used for an event, identification information of the headphone 1 and the like are stored.

Moreover, the storage portion 406 stores a sound signal of a sound source. The power supply portion 408 supplies power to each portion.

Figure 9:
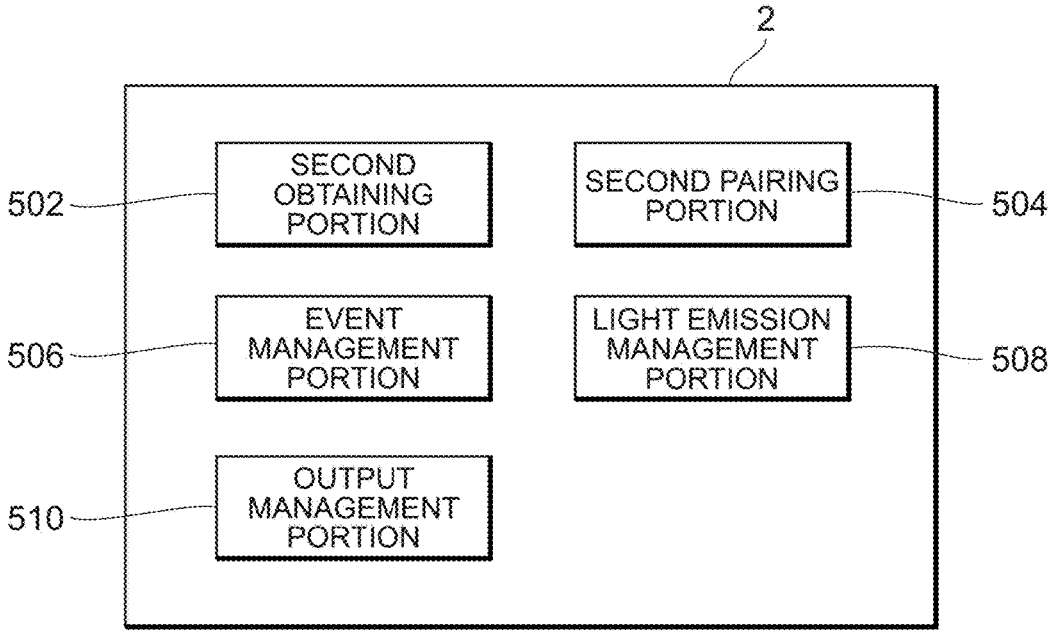
FIG. 9 is a view illustrating an example of functional configuration of the information processing device in the second embodiment.

FIG. 9 is a view illustrating an example of functional configuration of the information processing device 2 in the second embodiment. In the example illustrated in FIG. 9, the information processing device 2 has a second obtaining portion 502, a second pairing portion 504, an event management portion 506, a light emission management portion 508, and an output management portion 510.

The second obtaining portion 502, the second pairing portion 504, the event management portion 506, the light emission management portion 508, and the output management portion 510 can be realized by the control portion 402 illustrated in FIG. 8.

The second obtaining portion 502 obtains various signals and various information received from the server 3 and the headphone 1. For example, the second obtaining portion 502 obtains the event information from the server 3 and obtains a sound signal or obtains an identification number of the headphone 1 from the headphone 1 and obtains information relating to pairing.

The second pairing portion 504 obtains information relating to pairing such as common secret key information (link key) or a session key generated from the link key, for example, from the second obtaining portion 502 and performs pairing by using these pieces of information. The second pairing portion 504 starts pairing when a paring button on the screen is pressed, for example. At this time, the information processing device 2 may generate the common secret key information or may use the common secret key information determined in advance.

For example, the second pairing portion 504 performs pairing with the headphone 1 by using Bluetooth (registered trademark). As a result, communication in a master-slave relationship is established between the headphone 1 and the information processing device 2.

The event management portion 506 generates an event ID or the like and manages an event relating to the headphone 1 by using the generated event ID or the like. For example, the event management portion 506 of the information processing device 2 to the parent headphone 1 manages an event such as silent disco using the headphone 1. More specifically, the event management portion 506 may determine a frequency at which transmission is made to the sound signal or may embed an event ID in this sound signal. For example, the event management portion 506 embeds an event ID at every predetermined time as a modulation signal such as a DTMF (Dual Tone Multiple Frequency) or the like in a non-audible region of the sound signal. The embedding of the event ID may be performed when the event control portion 306 of the parent headphone 1 transmits a sound signal.

Moreover, the event management portion 506 of the information processing device 2 corresponding to the child headphone 1 executes control such that the event ID or frequency information obtained from the server 3 or the like is transmitted to the paired headphone 1. As a result, the child headphone 1 can obtain the event ID used for collation before reception of the sound signal or can set a frequency band to be delivered.

As a result, in the event, when the paid sound signal is to be delivered, for example, the parent headphone 1 having received the sound signal simultaneously transmits a sound signal to the child headphones 1, and only the specific headphone 1 having the event ID obtained when duly purchased can reproduce the sound signal.

Moreover, the event management portion 506 enables generation of an event by a user and uploads the information of the event created by the user to the server 3 or the like. As a result, in the other information processing devices 2, it becomes possible to view the event information from the server 3 or the like. Moreover, the event management portion 506 executes control such that connection is made to a purchase site as appropriate for ticket sales in the event. The event management portion 506 obtains the event ID and the frequency information from the server 3 or the like after the ticket is purchased.

The light emission management portion 508 generates a light emission control signal in accordance with a sound signal and manages it. The generated light emission control signal is transmitted to the headphone 1. As described above, by transmitting one light emission control signal to a plurality of the headphones 1, the plurality of headphones 1 can emit light in synchronization, and light performance can be arranged in a space in which the plurality of headphones 1 are present.

The output management portion 510 obtains a sound signal or the like from the event management portion 506 and manages so that it is output to the headphone 1. For example, the output management portion 510 manages a sound signal output in accordance with an event.

As a result, at an event, the sound signal transmitted by the information processing device 2 can be transmitted to a large number of headphones 1, and the one sound signal can be reproduced by the plurality of headphones 1. Thus, in the second embodiment, an event such as silent disco can be realized.

The output management portion 510 may manage a playlist and the like of a sound signal stored in the storage portion 406 and output a sound signal selected by a user to the headphone 1.

<Configuration of Server>

Hardware configuration of the server 3 is similar to the information processing device 2 illustrated in FIG. 8. Moreover, into the server 3, information of an event created by the information processing device 2 or the like is uploaded so that information of this event can be searched. Moreover, in the case of a paid event, the server 3 is connected to a purchase site so as to enable purchase of a ticket to the paid event.

<Screen Example>

Figure 10:
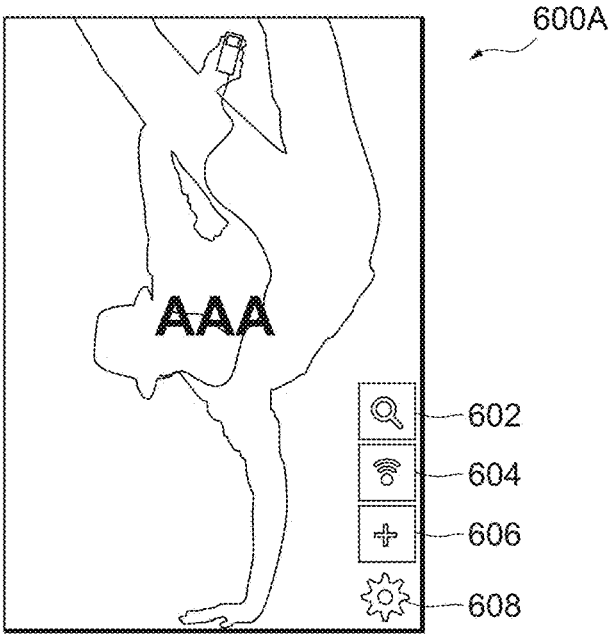
FIG. 10 is a view illustrating an example of a home screen when an application controlling the headphone is started by the information processing device.

Subsequently, a screen example will be described. FIG. 10 is a view illustrating an example of a home screen when an application for controlling the headphone 1 is started by the information processing device 2. On a screen 600A illustrated in FIG. 10, an image indicating a home, a first search button 602, a second search button 604, an event creation button 606, and a setting button 608 are displayed.

The first search button 602 is a button for searching an event, music or the like. The second search button 604 is a button for searching an event capable of receiving a sound signal at a current position and for displaying event information. The event creation button 606 is a button for creating an event. The setting button 608 is a button for making setting relating to user registration or the headphone 1.

Figure 11:
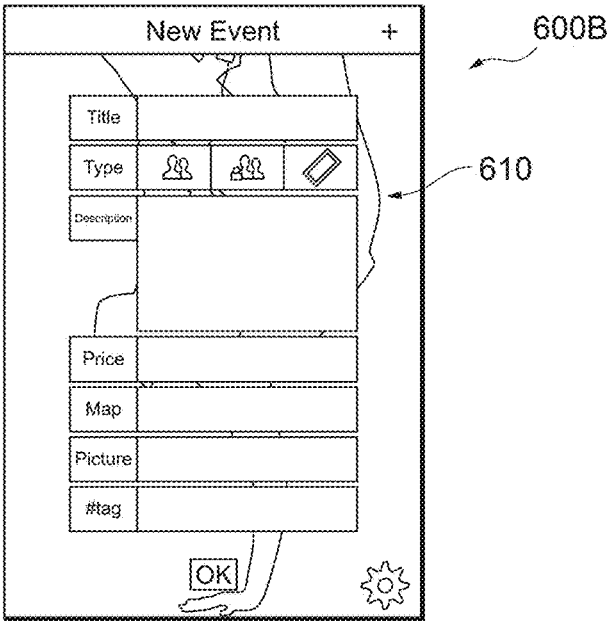
FIG. 11 is a view illustrating an example of an event creating screen.

FIG. 11 is a view illustrating an example of the event creation screen. On the screen 600B illustrated in FIG. 11, input columns for a title, a type, explanation, a price, place or the like of the event are displayed when the event creation button 606 is pressed down. The user can create an event by entering in these input columns.

Moreover, when the user enters in the input columns on the screen 600B illustrated in FIG. 11 and presses an OK button, creation of the event is completed, and information of the created event is uploaded to the server 3 or transmitted to the information processing device 2 of a predetermined user.

Figure 12:
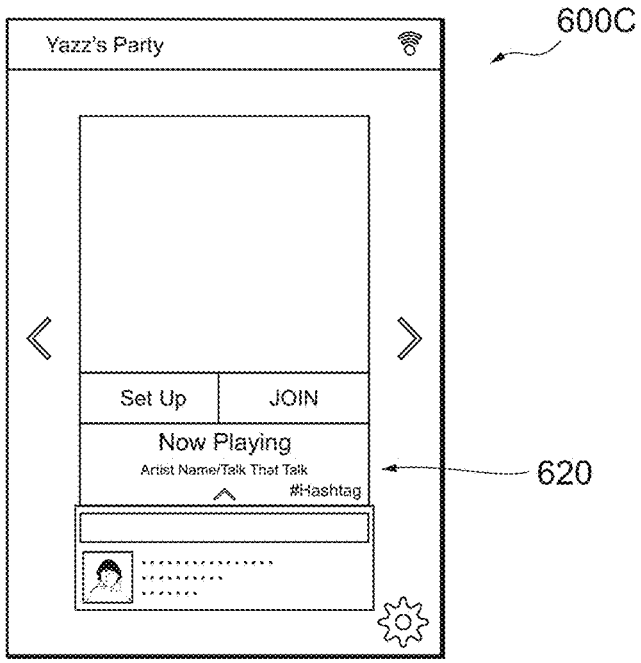
FIG. 12 is a view illustrating an example of an event screen (No. 1).

FIG. 12 is a view illustrating an example of an event screen (No. 1). A screen 600C illustrated in FIG. 12 is displayed when the second search button 604 is pressed down, and a display region 620 indicating an outline of an event is displayed.

Figure 13:
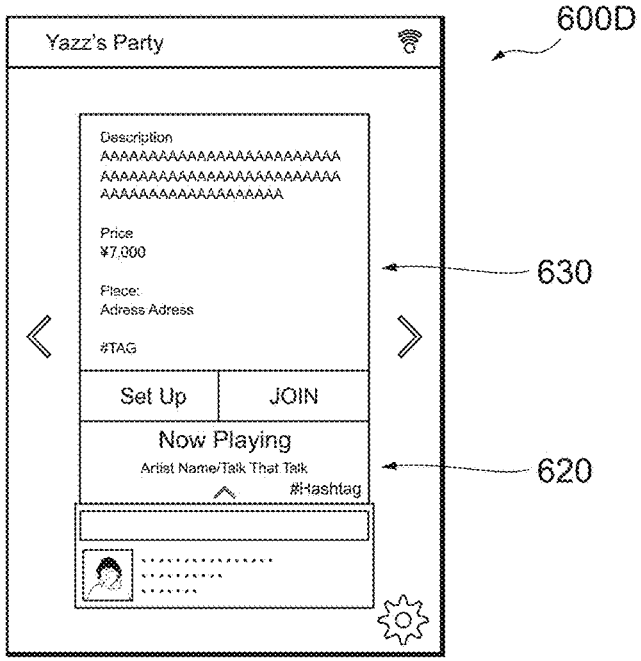
FIG. 13 is a view illustrating an example of an event screen (No. 2).

FIG. 13 is a view illustrating an example of an event screen (No. 2). A screen 600D illustrated in FIG. 13 is displayed when a "Set Up" button on the screen illustrated in FIG. 12 is pressed down, and a display region 630 illustrating detailed information of the event is displayed.

Figure 14:
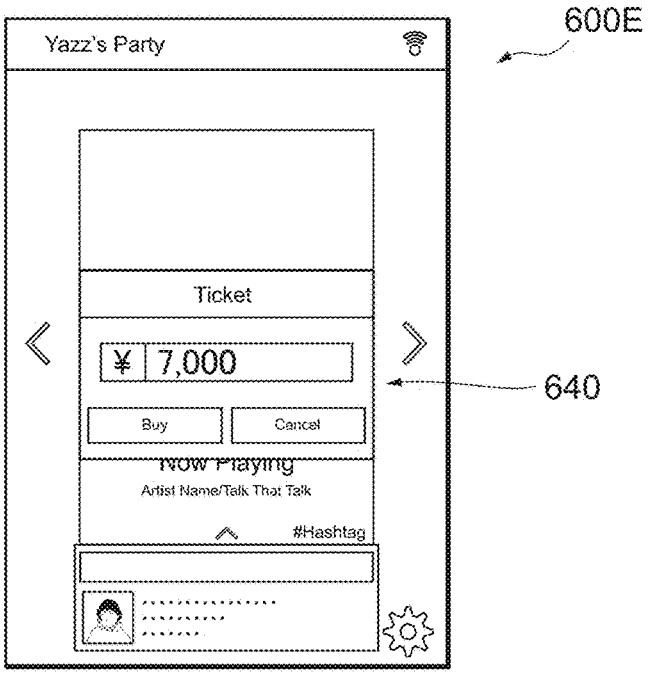
FIG. 14 is a view illustrating an example of an event screen (No. 3).

FIG. 14 is a view illustrating an example of an event screen (No. 3). A screen 600E illustrated in FIG. 14 is displayed when a "JOIN" button on the screen illustrated in FIG. 12 is pressed down, and a display region 640 for purchasing a ticket to the event is displayed.

Figure 15:
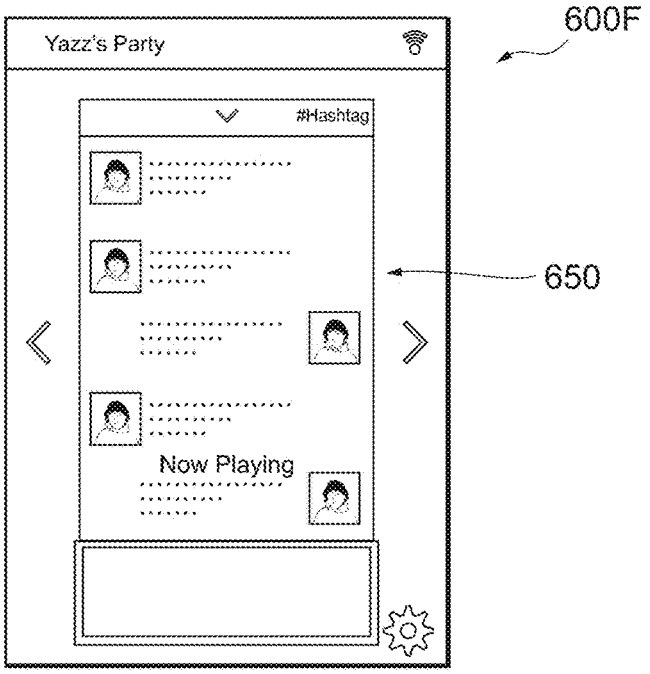
FIG. 15 is a view illustrating an example of an event screen (No. 4).

FIG. 15 is a view illustrating an example of an event screen (No. 4). A screen 600F illustrated in FIG. 15 is one of screens displayed after Hashtag is selected in the screen illustrated in FIG. 12. In the screen 600F illustrated in FIG. 15, reception of provision of a social networking service among event participants is enabled. As a result, communication among the participants can be promoted.

<Operation>

Figure 16:
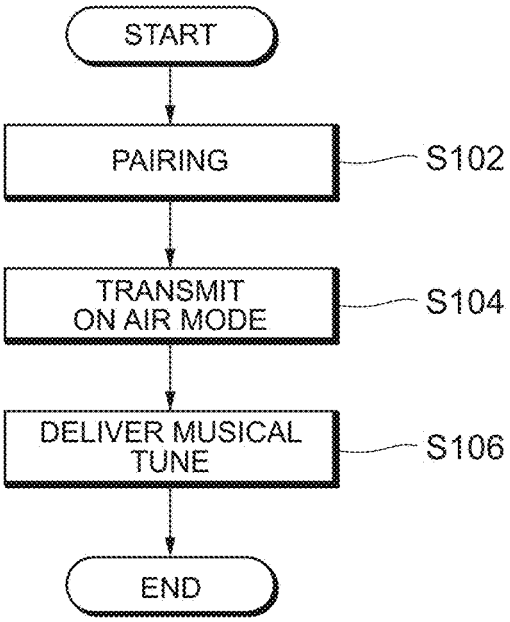
FIG. 16 is a flowchart illustrating an example of musical tune delivery processing on a transmission side.
Figure 17:
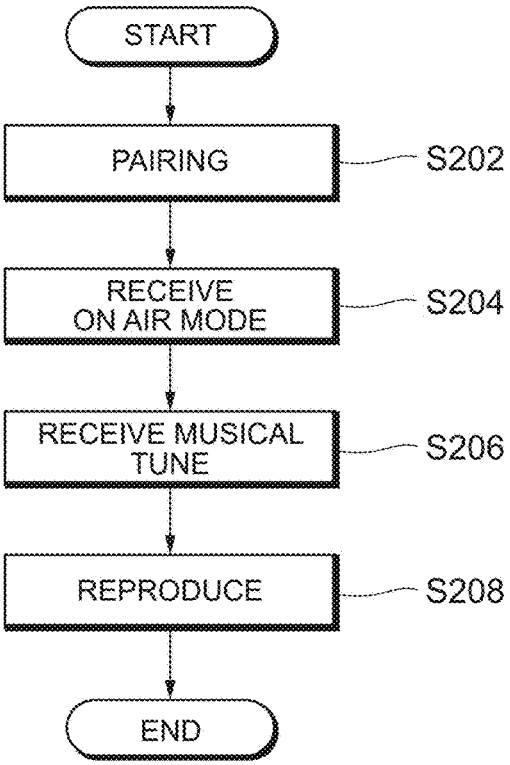
FIG. 17 is a flowchart illustrating an example of musical tune reception processing on a reception side.

Subsequently, an operation of the delivery system 200 will be described. FIGS. 16 and 17 explain processing relating to transmission/reception of a musical tune on transmission/reception sides, and FIGS. 18 to 20 explain processing relating to an event.

FIG. 16 is a flowchart illustrating an example of musical tune delivery processing on the transmission side. At Step S102 illustrated in FIG. 16, the transmission side or the information processing device 2, for example, executes pairing with the corresponding parent headphone 1. For a method of pairing, a well-known method may be used.

At Step S104, the information processing device 2 transmits an ON AIR mode to the headphone 1. For this communication, Bluetooth (registered trademark), for example, is used. By receiving this ON AIR mode from the information processing device 2 which created the event, the parent headphone 1 is set in the transmission mode.

At Step S106, the parent headphone 1 executes simultaneous delivery of a sound signal of a musical tune to the child headphones 1 present within a communication range of the second communication portion 112.

FIG. 17 is a flowchart illustrating an example of musical tune reception processing on the reception side. At Step S202 illustrated in FIG. 17, the reception side or the headphone 1, for example, executes pairing with the corresponding information processing device 2. For a method of pairing, a well-known method may be used.

At Step S204, the child headphone 1 receives the ON AIR mode from the information processing device 2. For this communication, Bluetooth (registered trademark), for example, is used. By receiving this ON AIR mode from the information processing device 2 participating in the event, the child headphone 1 is set in the reception mode.

At Step S206, the child headphone 1 receives the sound signal of the musical tune from the parent headphone 1. At this time, if the sound signal includes an event ID, the child headphone 1 extracts the event ID and executes collation processing.

At Step S208, the child headphone 1 reproduces the sound signal. As a result, one musical tune can be reproduced in synchronization in a plurality of the headphones 1, and silent disco or the like can be realized.

Figure 18:
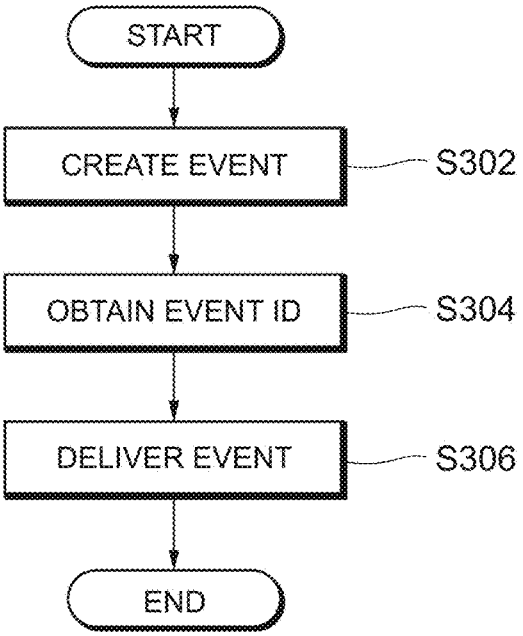
FIG. 18 is a flowchart illustrating an example of processing relating to event creation.

FIG. 18 is a flowchart illustrating an example of processing relating to event creation. At Step S302 illustrated in FIG. 18, the information processing device 2 creates an event (see FIG. 11, for example).

At Step S304, the information processing device 2 obtains an event ID for discriminating events in event creation. After that, the information processing device 2 stores information on the event including the event ID in the server 3 or a local memory.

At Step S306, the information processing device 2 executes delivery of the created event. The delivery of the event is executed by push communication or notification at a predetermined site or the like. As a result, the user can create an event and can deliver the event.

Figure 19:
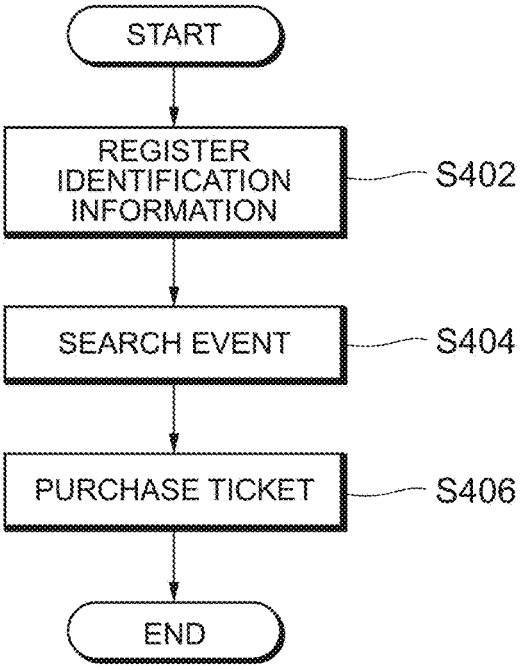
FIG. 19 is a flowchart illustrating an example of processing relating to event participation.

FIG. 19 is a flowchart illustrating an example of processing relating to event participation. At Step S402 illustrated in FIG. 19, the information processing device 2 registers identification information of the corresponding headphone 1 in an application. If the identification information of the headphone 1 has been already registered, this processing is unnecessary.

At Step S404, the information processing device 2 searches an event registered in the server 3 or the local memory.

At Step S406, if the searched event is a paid event, the information processing device 2 purchases a ticket through an operation by a user (see FIG. 14, for example). As a result, participation in the event is enabled. In the case of a free event, Step S406 is unnecessary.

Figure 20:
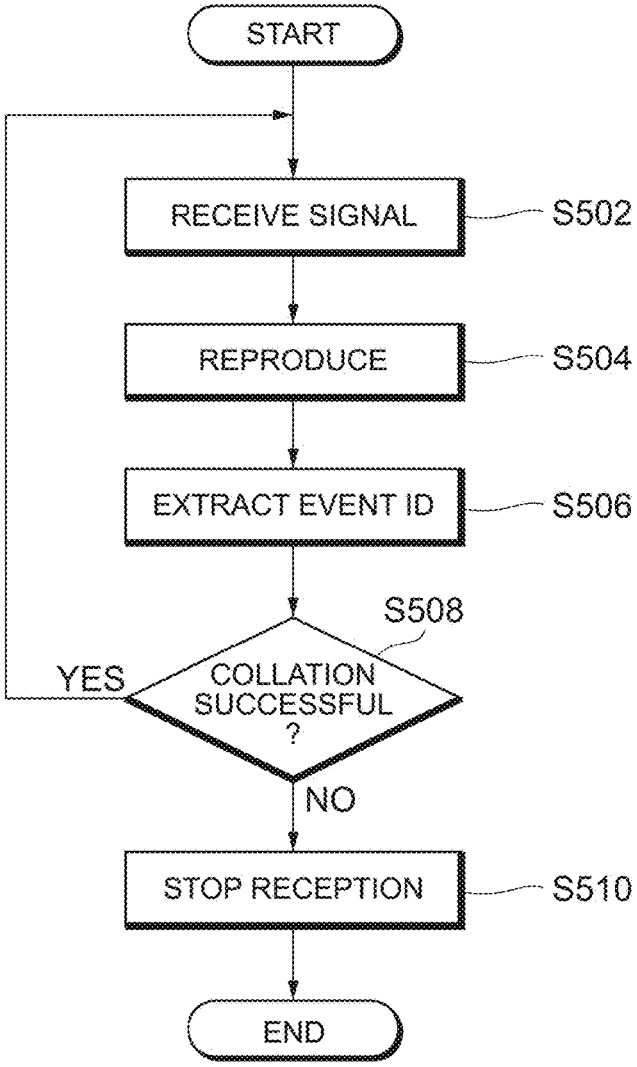
FIG. 20 is a flowchart illustrating an example of reproduction processing a musical tune in an event.

FIG. 20 is a flowchart illustrating an example of reproduction processing of a musical tune in an event. At Step S502 illustrated in FIG. 20, the child headphone 1 receives a sound signal from the parent headphone 1.

At Step S504, the child headphone 1 reproduces the obtained sound signal.

At Step S506, the child headphone 1 extracts the event ID from the sound signal.

At Step S508, the child headphone 1 executes collation processing by using the extracted event ID. When the collation is successful (YES at Step S508), the processing returns to Step S502, while if the collation fails (NO at Step S508), the processing proceeds to Step S510.

At Step S510, the child headphone 1 stops reception of the sound signal or stops reproduction of the sound signal. As a result, only the specific headphone 1 can be allowed to reproduce the musical tune. The collation processing is not necessarily needed but in the case of a free event or the like, it may be so configured that the headphone 1 can reproduce the received musical tune as it is.

As described above, the delivery system 200 in the second embodiment can use the headphone 1 in a predetermined event. For example, the headphone 1 can be used for an event such as silent disco. Moreover, by using a light emitting function of the headphone 1, light emission control of the headphone 1 present in an event site is executed so that the space is staged and the site is livened up.

Third Embodiment

Subsequently, an example of a headphone in a third embodiment will be described by using the attached drawings.

<Shape of Headphone>

Figure 21:
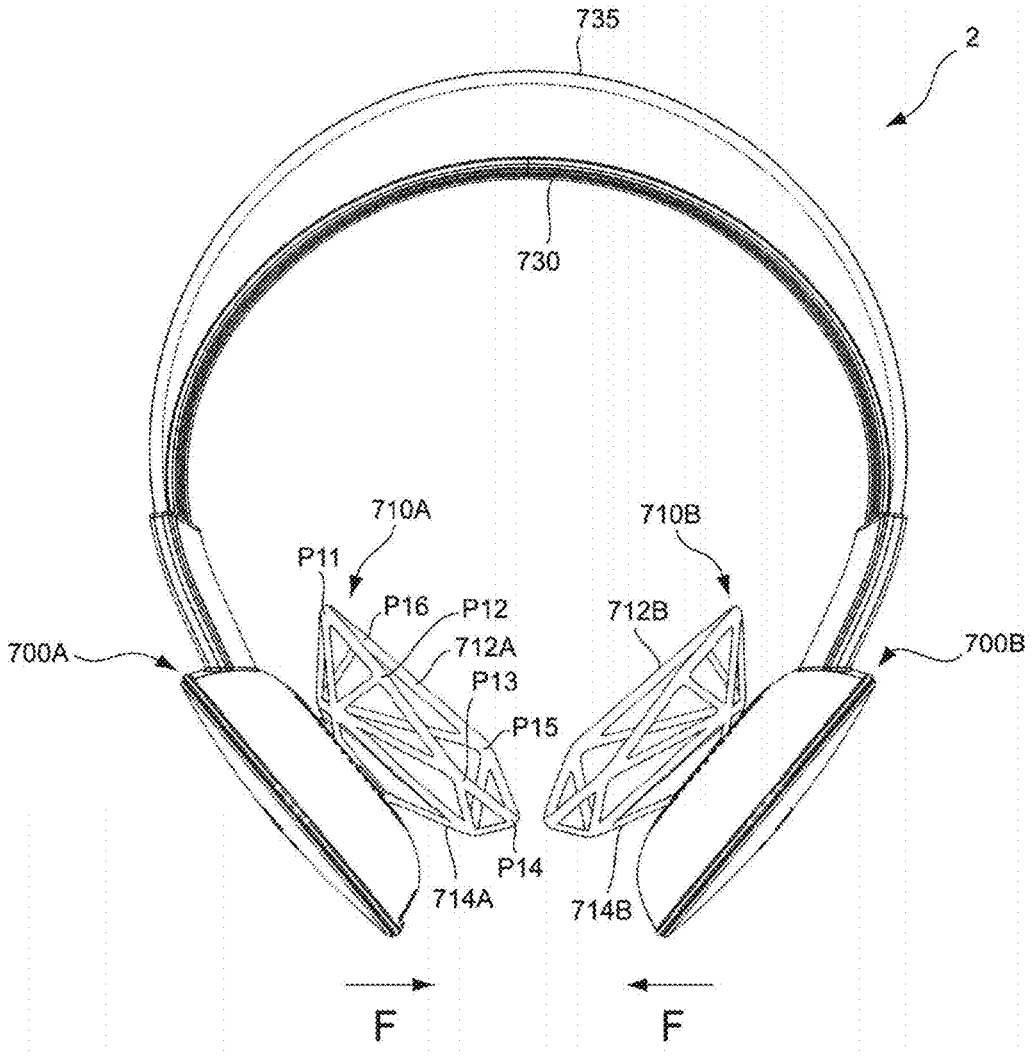
FIG. 21 is a front view of a headphone in a third embodiment.
Figure 22:
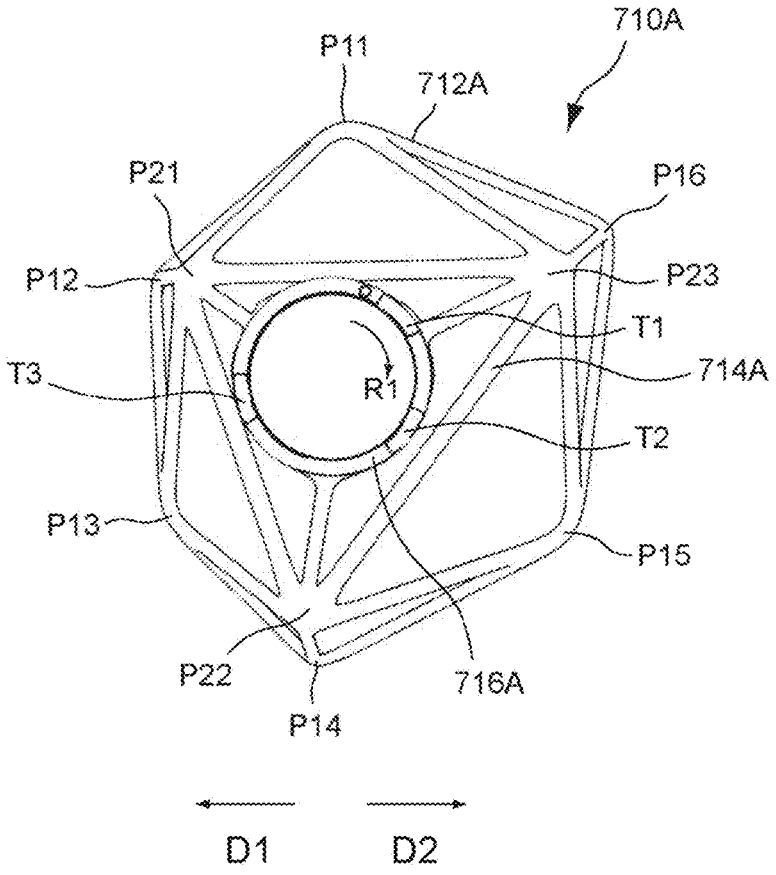
FIG. 22 is a front view of an ear accommodating portion.
Figure 23:
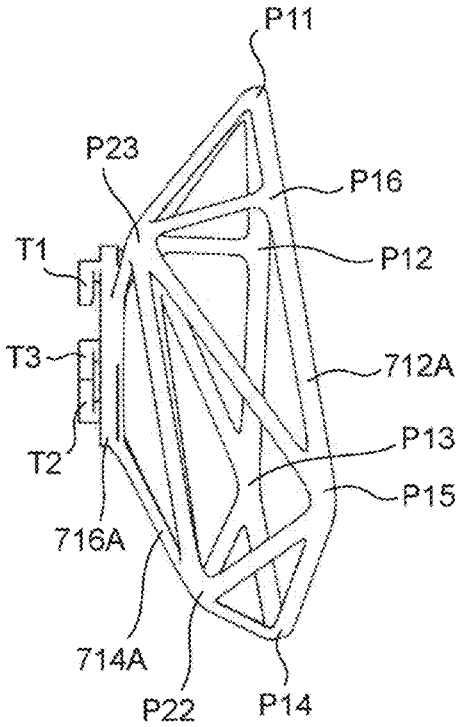
FIG. 23 is a right side view of the ear accommodating portion.

By using FIGS. 21 to 23, an example of the headphone in the third embodiment will be described. FIG. 21 is a front view of the headphone 2 in the third embodiment. FIG. 22 is a front view of an ear accommodating portion 710A. FIG. 23 is a right side view of the ear accommodating portion 710A.

In the headphone 2 in the third embodiment, frames 712A and 712B in the ear accommodating portions 710A and 710B in contact with the head part have a shape along the cranial bone or the head shape. For the cranial bone or the head shape, its standard shape is expressed by 3D data, and the shapes of the frames 712A and 712B are preferably designed and formed by using this 3D data. As a result, when the user wears the headphone 2, the entire frame 712A, for example, can be brought into contact along the cranial bone or the head shape easily and thus, a force for pressing the periphery of the ear by the frame 712A can be distributed to the entire frame 712A.

Moreover, the ear accommodating portion 710A in the third embodiment is designed so that, while the force for pressing the periphery of the ear is distributed as described above, the speaker is brought as close as possible to the ear in order to prevent sound leakage, and strength is kept while ventilation is provided similarly to the first embodiment.

In FIG. 21, the headphone 2 has a pair of ear accommodating portions 710A and 710B, a pair of housings 720A and 720B, an arm A730, and an arm B735. The constitutions other than ear accommodating portions 710A and 710B, and the arm A730 and the arm B730 in the third embodiment are similar to the corresponding constitutions in the first embodiment.

The arm A730 has an arc shape so as to follow the head parietal region of the wearer and is formed by using a member having cushioning characteristics, for example. The arm B735 is provided on an outer side of the arm A730, for example. Moreover, the arm B735 generates a force F on the side for pressing the ear when the headphone 2 is expanded in a direction to be separated from the ear in order to fit the headphone 2 to the ear. In other words, the arm B735 generates the force F in a direction where the pair of ear accommodating portions 710A and 710B are faced with each other when the pair of ear accommodating portions 710A and 710B is moved in a direction separated from each other. The arm B735 is formed by an elastic member, for example.

The ear accommodating portion 710 in the third embodiment has a shape different from the ear accommodating portion 10 in the first embodiment. In the following, the ear accommodating portion 710 in the third embodiment will be mainly described but since the ear accommodating portions 710A and 710B have constitutions of plane symmetry to each other, the ear accommodating portion 710A is described as an example.

The frame 712A of the ear accommodating portion 710A is constituted by a frame-shaped member having vertexes P11, P12, P13, P14, P15, and P16. The frame 712A including a member connecting these vertexes has a shape following the cranial bone or the head shape on which the headphone 2 is worn.

For example, the frame 712A is a hexagon, and at least two vertexes of the vertexes are not on the same plane. As a result, the frame 712A can follow an irregular shape of the periphery of the ear. For example, the vertex P11 is located on an ear upper part when the headphone 2 is worn, the vertex P12 is located on an ear upper front part when being worn, the vertex P13 is located on an ear lower front part when being worn, the vertex P14 is located on an ear lower part when being worn, the vertex P15 is located on an ear lower rear part when being worn, and the vertex P16 is located on an ear upper rear part when being worn.

Moreover, regarding each vertex of the frame 712A, in the front view of the headphone 2 illustrated in FIG. 21 and in the front view of the ear accommodating portion 710A illustrated in FIG. 22, the vertex P11 is located in an arm direction, while the vertex P14 is located in a direction opposite to the arm. The vertexes P12 and P13 are located on a front (frontal region direction) of the headphone 2 from a reference line of the vertexes P11 and P14, and the vertexes P15 and P16 are located on a rear (occipital region direction) of the headphone 2 from this reference line.

Moreover, with respect to the same plane formed by the vertexes P11, P12, and P14, the vertex P13 is located above (a direction closer to the housing 700A is assumed to be an upper side) from this same plane in accordance with a projecting shape of a cheek bone, while the vertexes P15 and P16 are located below (a direction away from the housing 700A is assumed to be a lower side) from the same plane in accordance with the recess behind the ear. Moreover, the vertex P15 is located in a direction away from the same plane rather than the vertex P16.

Figure 24:
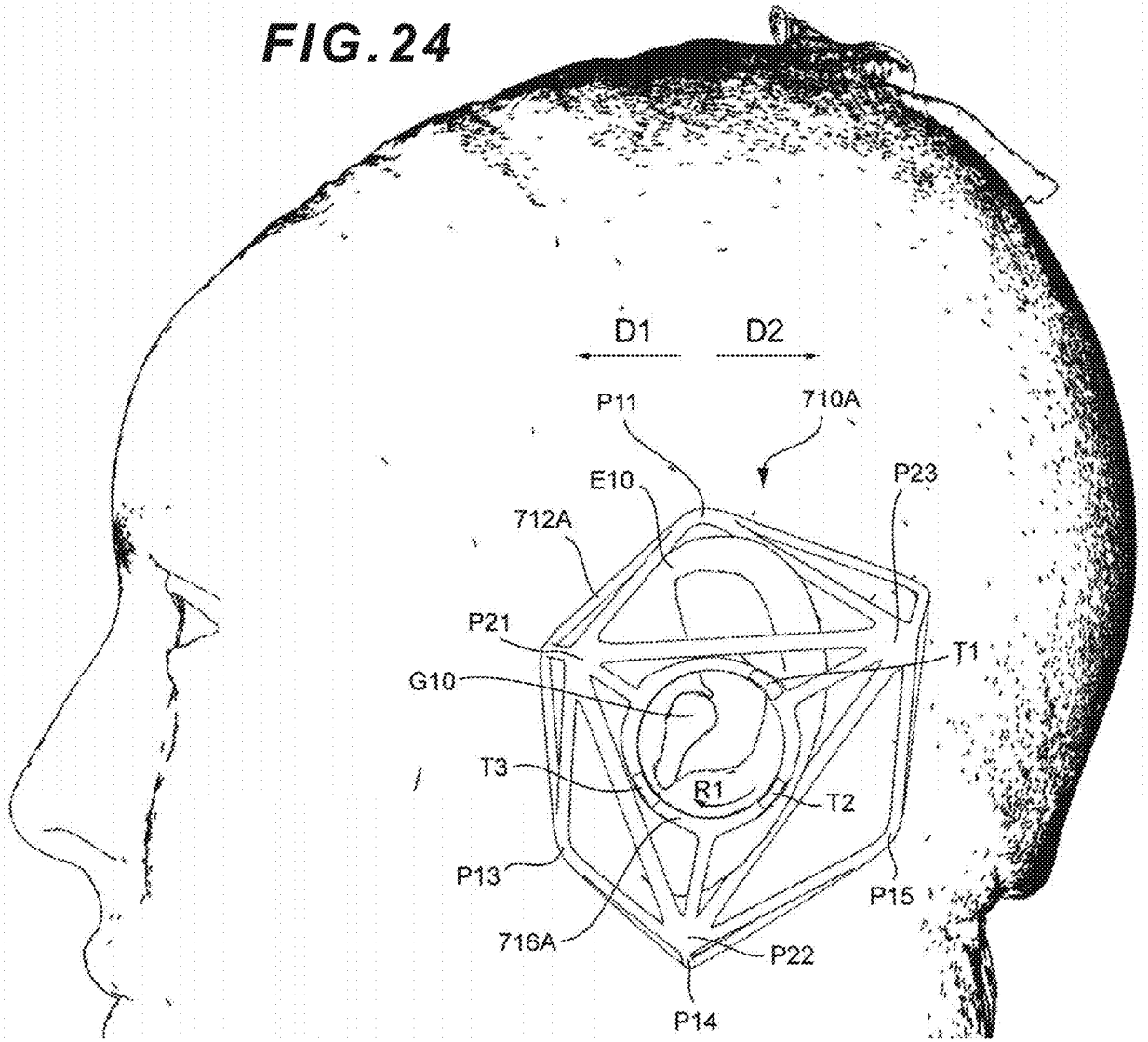
FIG. 24 is a view illustrating a relationship between the ear accommodating portion and the ear.

Moreover, as described above, a structure of the frame 712A on a front view has a hexagonal shape (see FIG. 22), and each line segment connecting the vertexes P11, P16, and P15 located in a D2 direction and P14 is longer than each line segment connecting the vertexes P11, P12, and P13 located in a D1 direction and P14. In other words, when the hexagon is divided by the segment of the vertex P11 and the vertex P14, an area of a square P11, P12, P13, and P14 is smaller than an area of a square P11, P14, P15, and P16. An arrow D1 illustrated in FIGS. 22 and 24 is the frontal region direction, while an arrow D2 is the occipital region direction.

Moreover, the ear accommodating portion 710A has a connection portion 714A, and the connection portion 714A has a mounting portion 716A to be mounted on the housing 700A. The mounting portion 716A has a ring shape in the example illustrated in FIG. 22, but this is not limiting. Moreover, the mounting portion 716A has claw portions T1, T2, and T3, and these claw portions T1, T2, and T3 are fitted in recess portions (not shown) of the housing 700A and rotated so as to be mounted on the housing 700A.

The claw portions T1, T2, and T3 are not provided at equal positions on a ring shape (at 120-degree angle each, for example) but provided at random positions. As a result, an appropriate mounting position of the ear accommodating portion 710A can be determined uniquely.

Moreover, the claw portions T1, T2, and T3 are fitted in the housing 700A, rotated in the direction of a direction R1 (right rotation when seen from the housing 700A side and left rotation when seen from the mounting side) and mounted. Moreover, in the case of the ear accommodating portion 7106 for the right ear, they are rotated to the left when seen from the housing 700B and to the right when seen from the mounting side and mounted. This is because it is known from the inventors' experiments that when a user wearing a normal headphone does exercise, the headphone (the arm portion, for example) often shifts to the frontal region direction D1. Thus, if the arm of the headphone shifts to the frontal region direction D1, the ear accommodating portion 710A rotates to a direction where it is further tightened with respect to the housing 700A, whereby removal of the ear accommodating portion 710A from the housing 700A can be prevented.

The connection portion 714A connects the frame 712A and the mounting portion 716A by a triangular rib structure. As a result, when the headphone 2 is worn, strength can be kept while ventilation around the ear is provided. The vertexes P21, P22, and P23 located between the frame 712A and the mounting portion 716A are in the direction away from the housing 700A in the mounting portion 716A, for example, such that the vertex P21 and P23 are provided at positions closer to the mounting portion 716A than the vertex P22. Each of the vertexes P11 to P16 described above is provided at positions in the direction away from the housing 700A rather than the vertexes P21 to 23.

Moreover, the mounting portion 716A is located on an inner side of a triangle formed by each of the vertexes P21, P22, and P23. Each of the vertexes P21, P22, and P23 are located on an inner side of the hexagonal frame 712A. A relationship of lengths of line segments is the line segment of P23 to P22>the line segment of P22 to P21≈the line segment of P21 to p23.

Moreover, from each of the vertexes P21, P22, and P23 to the rib of the mounting portion 716A, a rib is formed so as to go toward the center of the mounting portion 716A. Here, a relationship is formed among an area of the mounting portion 716A<an area of a triangle P21, P22, and P23<an area of the frame 712A. Moreover, on a front view illustrated in FIG. 22, the vertex P21 is provided at a position closest to the vertex P12, the vertex P22 is provided at a position closest to the vertex P14, and the vertex P23 is provided at a position closest to the vertex P16.

Moreover, when the headphone 2 is worn, in order to ensure that the ear accommodating portion 710A does not shift easily, the triangular rib structure connecting the vertexes P11, P21, and P23 can be hooked by the ear (see FIG. 24). As a result, the headphone 2 can be stably worn. The triangle formed by these vertexes P11, P21, and P23 is larger than an adjacent triangle. Thus, the ear can penetrate a gap in this triangle easily.

In the right side view illustrated in FIG. 23, a rib connecting the vertexes P23 and P22, a rib connecting the vertexes P22 and P21 (the vertex located on a rear side of P23 illustrated in FIG. 23), and a rib connecting the vertexes P11 and P15 are substantially in parallel. This is for the headphone to follow the shape of the ear when seen from the rear side of the ear when the headphone 2 is worn. By means of the aforementioned constitution, the ear accommodating portion 710A can be brought further closer to the ear. As described above, the vertexes P21 and P23 are provided at positions closer to the mounting portion 716 side than the vertex P22.

FIG. 24 is a view illustrating a relationship between the ear accommodating portion and the ear. As illustrated in FIG. 24, the ear accommodating portion 710A is worn in a state further closer to an ear E10. In the example illustrated in FIG. 24, the speaker is provided at the center part of the mounting portion 716A so that a sound having directivity output from the speaker directly enters to the depth of an external auditory canal G10. As a result, sound leakage can be prevented as much as possible.

In the example illustrated in FIG. 24, as described above, a state where the ribs forming the triangle connecting the vertexes P11, P21, and P23 are hooked by the ear E10 is shown. In the ear accommodating portion 701A in the third embodiment, other than uniform pressing of the frame 712A onto the ear peripheral portion, a structure that the ear accommodating portion 710A does not shift while worn is provided.

Moreover, the rib structure may be constituted such that the peripheral edge portion of the ear is held in the gap among the vertexes P22 and P23, and the mounting portion 716A. As a result, shifting of the ear accommodating portion 710A can be further prevented.

Moreover, when the ear accommodating portion 710A is worn by a user, it is worn such that the vertex P14 is inclined more in an F direction than the vertex P11. By considering this inclination, the position of the speaker may be adjusted so that the sound output from the speaker reaches the depth of the external auditory canal G10.

As described above, according to the third embodiment, while the effect described in the first embodiment is held, when the frame of the ear accommodating portion further follows along the cranial bone or the head part shape, a fit feeling of the ear accommodating portion can be improved. By providing such a structure of the ear accommodating portion that the speaker is brought further closer to the ear, sound leakage can be prevented as much as possible.

[Variation]

A plurality of embodiments of the art disclosed by the present application has been described, but the art disclosed by the present application is not limited to the above. For example, a delivering device for delivering a musical tune may be provided at an event site, and this delivering device may deliver a sound signal of the musical tune to each of the headphones 1 through each of the information processing devices 2. Moreover, the parent information processing device 2 may deliver the sound signal using a wireless network to the other information processing devices 2, and each of the information processing devices 2 having received the sound signal may transmit the sound signal to the paired headphones 1.

In any case, one musical tune can be provided into the site. Moreover, even in the case of a paid event, when the delivering device or the parent information processing device 2 delivers the sound signal with the event ID embedded therein, the headphone 1 having obtained the event ID with the ticket purchase can be allowed to reproduce the sound signal.

Moreover, the program of the information processing device 2 of the present invention can be installed in or loaded in a computer by downloading through various recording mediums including an optical disk such as a CD-ROM, a magnetic disk, a semiconductor memory and the like or via a communication network.

Moreover, in the Description and the like, a term "portion" does not simply mean a physical constitution but also includes a case where a function provided in the constitution is realized by software. Moreover, the function provided in one constitution may be realized by two or more physical constitutions, or the function of two or more constitutions may be realized by one physical constitution. Moreover, a term "system" includes a system composed of an information processing device and the like and providing a specific function to a user. It is constituted by a server device, a cloud computing form, an ASP (Application Service Provider), a client server model and the like but they are not limiting.

REFERENCE SIGNS LIST

1, 2 headphone
2 information processing device
3 server
10, 710 ear accommodating portion
20, 700 housing
30730, 735 arm

50 speaker unit
100 processing portion
106A, B light emission portion
104 first communication portion
112 second communication portion
302 first obtaining portion
304 first pairing portion
306 event control portion
308 light emission control portion
310 output control portion
502 second obtaining portion
504 second pairing portion
506 event management portion
508 light emission management portion
510 output management portion

What is claimed is:

1. A headphone comprising:

a pair of housings including speaker units;

an ear accommodating portion having a frame in contact with a head part around an ear and a connection portion connecting the frame and the housings, covering the ear, and providing ventilation to the ear; and an arm connected to the pair of housings, wherein at least two vertexes of vertexes of a peripheral edge portion of the frame are not located on a same plane defined by other vertexes of vertexes of the peripheral edge portion of the frame, the peripheral edge portion having contact with the head part around the ear.

2. The headphone according to claim 1, wherein the connection portion is connected to the housing at a center part of the housing.

3. The headphone according to claim 1, wherein in the connection portion, a surface faced with the housing has a projecting shape, and an apex portion of the projecting shape is connected to the housing.

4. The headphone according to claim 3, wherein in the housing, a surface faced with the ear accommodating portion has a projecting shape, and an apex portion of the projecting shape is connected to the apex portion of the connection portion.

5. The headphone according to claim 3, wherein the arm is connected on the apex portion of the ear accommodating portion or the housing.

6. The headphone according to claim 1, wherein the connection portion includes a mesh structure having a plurality of holes or openings substantially uniformly.

7. The headphone according to claim 6, wherein the holes or the openings are provided substantially uniformly on the entire circumference of the connection portion.

8. The headphone according to claim 1, wherein the ear accommodating portion has a plurality of triangular rib structures; and when the headphone is worn, the ear protrudes from the gap of at least one of the triangular rib structures.

9. The headphone according to claim 1, wherein the housing includes a wireless communication portion for receiving a sound signal; and the speaker unit outputs a sound based on the sound signal.

10. The headphone according to claim 9, wherein the speaker unit is a speaker unit which has a planar shape and directivity.

11. The headphone according to claim 9, further comprising:

a light emission portion which emits light on the basis of a light emission control signal received by the wireless communication portion.

* * * * *